US010984771B2

(12) United States Patent
Ichiki

(10) Patent No.: US 10,984,771 B2
(45) Date of Patent: Apr. 20, 2021

(54) ROTATING MECHANISM AND KEYBOARD APPARATUS

(71) Applicant: YAMAHA CORPORATION, Shizuoka (JP)

(72) Inventor: Shunsuke Ichiki, Shizuoka (JP)

(73) Assignee: YAMAHA CORPORATION, Tokyo (JP)

( * ) Notice: Subject to any disclaimer, the term of this patent is extended or adjusted under 35 U.S.C. 154(b) by 234 days.

(21) Appl. No.: 16/087,962

(22) PCT Filed: Feb. 21, 2017

(86) PCT No.: PCT/JP2017/006253
§ 371 (c)(1),
(2) Date: Sep. 24, 2018

(87) PCT Pub. No.: WO2017/163706
PCT Pub. Date: Sep. 28, 2017

(65) Prior Publication Data

US 2020/0320967 A1 Oct. 8, 2020

(30) Foreign Application Priority Data

Mar. 25, 2016 (JP) ..... 2016-061696

(51) Int. Cl.
*G10H 1/34* (2006.01)
*G10B 3/12* (2006.01)

(52) U.S. Cl.
CPC ..... *G10H 1/34* (2013.01); *G10B 3/12* (2013.01)

(58) Field of Classification Search
CPC ..... G10H 1/34
See application file for complete search history.

(56) References Cited

U.S. PATENT DOCUMENTS 4,157,051 A * 6/1979 Peterson ..... G10H 1/34 84/343
4,840,334 A * 6/1989 Kikuchi ..... F16L 3/13 24/453

(Continued)

FOREIGN PATENT DOCUMENTS

CN 104934017 A 9/2015
JP 05-154864 A 6/1993

(Continued)

OTHER PUBLICATIONS

Office Action for JP Patent Application No. 2016-061696, dated Feb. 18, 2020, 02 pages of Office Action and 03 pages of English Translation.

(Continued)

*Primary Examiner* — Robert W Horn
(74) *Attorney, Agent, or Firm* — Chip Law Group

(57) ABSTRACT

To realize a rotating mechanism by which a bearing section is stably rotated relative to a shaft section. A rotating mechanism includes a shaft section having a groove, and a bearing section which is provided with an opening for supporting the shaft section, has a shielding plate shielding part of the opening and disposed inside the groove, and is rotated around a rotational axis. The shielding plate may shield a region containing the rotational axis, and may have a projecting portion projecting from the shielding plate toward the inside of the groove, between the shielding plate and the groove.

11 Claims, 10 Drawing Sheets

(56) References Cited

U.S. PATENT DOCUMENTS 6,241,198 B1 * 6/2001 Maruyama ..... F16L 3/223 248/49
6,553,705 B2 * 4/2003 Geiberger ..... A47G 1/0611 40/647
7,219,931 B2 * 5/2007 Kato ..... B60R 16/0207 248/60
7,896,296 B2 * 3/2011 Julian ..... F16L 3/127 248/68.1
8,350,140 B2 * 1/2013 Taniguchi ..... G10H 1/34 84/423 R
8,530,732 B2 * 9/2013 Suzuki ..... G10H 1/346 84/243
8,882,059 B2 * 11/2014 Schmidt ..... F16L 3/1041 248/74.3
8,927,848 B2 * 1/2015 Kaneko ..... G10H 1/34 84/720
9,006,549 B2 * 4/2015 Suzuki ..... G10B 3/12 84/423 R
9,349,359 B2 * 5/2016 Takata ..... G10H 1/346
9,383,041 B2 * 7/2016 Kanie ..... F16L 3/13
9,607,587 B2 * 3/2017 Suzuki ..... G10B 3/12
9,899,014 B2 * 2/2018 Nishimura ..... G10H 1/346
10,373,596 B2 * 8/2019 Suzuki ..... G10H 1/346
10,665,217 B2 * 5/2020 Ichiki ..... G10C 3/12
2015/0269915 A1 9/2015 Taniguchi
2019/0043459 A1 * 2/2019 Ichiki ..... G10C 3/12
2019/0378486 A1 * 12/2019 Kamiya ..... G10C 3/18

FOREIGN PATENT DOCUMENTS

JP 5-154864 A 6/1993
JP 2002-207484 A 7/2002
JP 2008-286358 A 11/2008
JP 2009-063923 A 3/2009
JP 2015-184327 A 10/2015

OTHER PUBLICATIONS

International Search Report and Written Opinion of PCT Application No. PCT/JP2017/006253, dated May 9, 2017, 02 page of English Translation and 07 pages of ISRWO.

* cited by examiner (A)

(B)

ROTATING MECHANISM AND KEYBOARD APPARATUS

CROSS REFERENCE TO RELATED APPLICATIONS

This application is a U.S. National Phase of International Patent Application No. PCT/JP2017/006253 filed on Feb. 21, 2017, which claims priority benefit of Japanese Patent Application No. JP 2016-061696 filed in the Japan Patent Office on Mar. 25, 2016. Each of the above-referenced applications is hereby incorporated herein by reference in its entirety.

TECHNICAL FIELD

The present invention relates to a rotating mechanism. In addition, the present invention relates to a keyboard apparatus provided with a rotating mechanism.

BACKGROUND ART

Existing acoustic pianos such as grand pianos and upright pianos are composed of a large number of component parts. In addition, assemblage of these component parts is extremely complicated, so that the time required for an assembling operation would be long. Particularly, an action mechanism provided correspondingly to each key requires a large number of component parts, and an assembling operation thereof is also extremely complicated.

The action mechanism has a hammer provided with a weight on the lower side of the key, for giving a feeling (hereinafter, referred to a touch feeling) to a player's finger through the key. The hammer is rotated such as to lift up the weight provided for the hammer, according to a key depressing operation on the key. For instance, a hammer depicted in PTL 1 is mounted to a frame by fitting a bearing section, which is opened in a circular shape, to a shaft section. In PTL 1, the bearing section is mounted to the shaft section by a so-called snap-fit wherein the width between opening ends of the bearing section is narrow as compared to the diameter of the shaft section.

CITATION LIST

Patent Literature

[PTL 1]
JP 2002-207484A

SUMMARY

Technical Problem

In the structure of the general snap-fit depicted in PTL 1, an opening provided in the bearing section holds the shaft section. The opening is flexible in a normal direction at a point of contact between the bearing section and the shaft section in the vicinity of the opening end. Owing to the flexibility of the opening ends, the attachment and detachment of the shaft section and the bearing section to and from each other are performed. However, with the bearing section provided with the opening, the rigidity of the bearing section in the vicinity of the opening is lowered. In addition, when the rigidity of the bearing section is lowered, the bearing section may be deformed in such a manner as to increase the opening diameter of the opening. When the opening of the bearing section is deformed, a rotating operation of the bearing section relative to the shaft section would be chattered, leading to the problem of an instable rotating operation.

One of objects of the present invention is to realize a rotating mechanism by which a bearing section is stably rotated relative to a shaft section.

Solution to Problem

A rotating mechanism according to one embodiment of the present invention includes a shaft section, and a bearing section that has an inner peripheral surface making contact with an outer peripheral surface of the shaft section and that is rotated around a rotational axis relative to the shaft section. The inner peripheral surface of the bearing section is formed with an extension portion extending from the inner peripheral surface toward the rotational axis, and the outer peripheral surface of the shaft section is formed with a groove in an inside of which the extension portion in an inserted state can be moved when the bearing section is rotated relative to the shaft section.

In addition, the extension portion may shield a region containing the rotational axis.

Besides, the extension portion may have a projecting portion projecting from the extension portion toward the inside of the groove.

In addition, the shaft section may have a projecting portion projecting from an inner surface of the groove toward the extension portion, inside the groove.

Besides, the projecting portion may be provided in a region containing the rotational axis.

In addition, the extension portion may be provided with a through-hole penetrating the extension portion in a plate thickness direction.

Besides, the extension portion may be disposed at an end portion of the bearing section, in a first direction parallel to the rotational axis.

In addition, the extension portion may be disposed between both ends of the bearing section, in the first direction.

Besides, the bearing section may have a rib at an end portion on a side opposite to an end portion where the extension portion is provided, in the first direction, at an outer peripheral surface of the bearing section.

In addition, the shaft section may be provided with a plurality of grooves arranged in the first direction.

A keyboard apparatus according to one embodiment of the present invention includes a key, a hammer assembly rotated around the rotating mechanism in response to depression of the key, a sensor that is disposed under the key and detects an operation on the key, and a sound source section that generates a sound waveform signal according to an output signal from the sensor.

Advantageous Effect of Invention

According to the present invention, it is possible to realize a rotating mechanism by which a bearing section is stably rotated relative to a shaft section.

DESCRIPTION OF EMBODIMENTS

Figure 1:
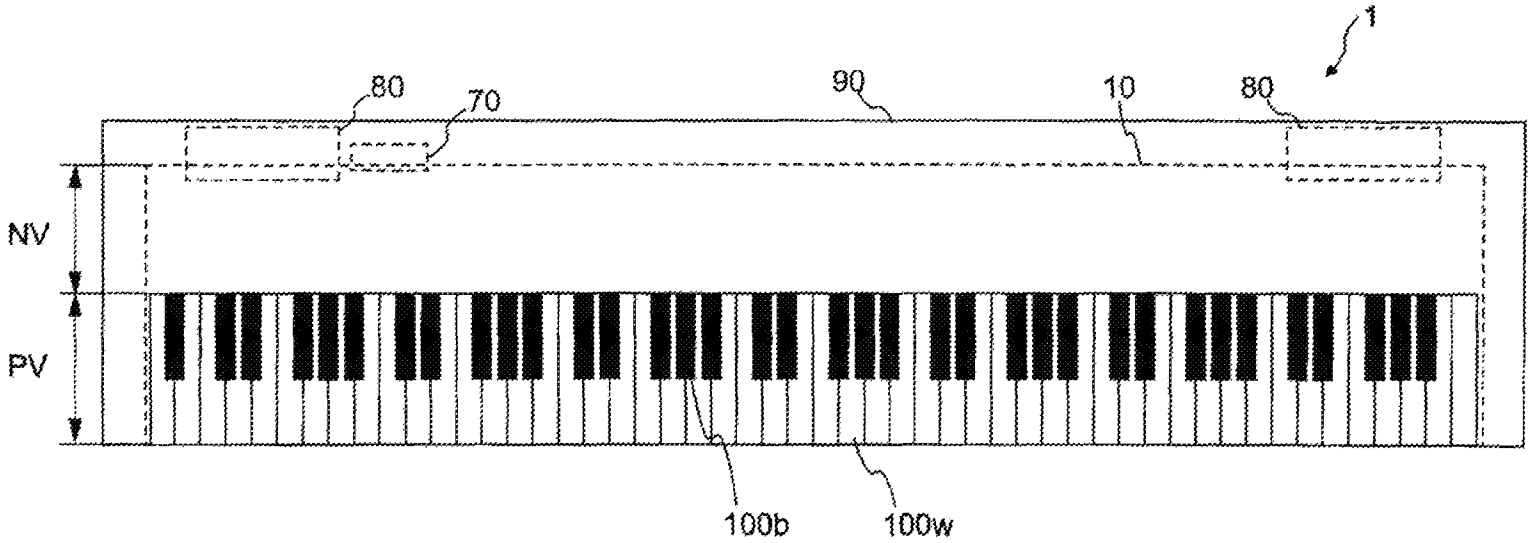
FIG. 1 is a figure depicting the configuration of a keyboard apparatus in one embodiment of the present invention.

A keyboard apparatus in one embodiment of the present invention will be described in detail below, referring to the drawings. The following embodiments are examples of the embodiments of the present invention, and the invention is not to be limited to these embodiments. Note that in the drawings referred to in the present embodiments, the same parts or the parts having similar functions are denoted by the same or similar reference symbols (reference symbols composed simply of numerals followed by A, B or the like), and repeated descriptions of them may be omitted. In addition, dimensional ratios (ratios between components, ratios between dimensions in a longitudinal direction and dimensions in a transverse direction, etc.) in the drawings may be different from the actual ratios for convenience of description, and some of the components may be omitted from the drawings. Besides, in the following description, "rotating" means a relative motion. For example, "a member A is rotated relative to a member B" may mean that the member B is moved relative to the member A which is fixed, or may mean that, in contrast, the member A is rotated relative to the member B which is fixed, or may mean that both of the members are rotated.

First Embodiment

[Configuration of Keyboard Apparatus]

FIG. 1 is a figure depicting the configuration of a keyboard apparatus in a first embodiment. A keyboard apparatus 1, in this example, is an electronic keyboard instrument that generate sounds according to depression of keys by a user (player), such as an electronic piano. Note that the keyboard apparatus 1 may be a keyboard type controller that outputs control data (for example, musical instrument digital interface (MIDI)) for controlling an external sound source device according depression of keys. In this case, the keyboard apparatus 1 need not have a sound source device.

The keyboard apparatus 1 includes a keyboard assembly 10. The keyboard assembly 10 includes white keys 100*w* and black keys 100*b*. Pluralities of the white keys 100*w* and black keys 100*b* are arranged in an aligned pattern. The number of keys 100 is N, which is 88, in this example. The direction in which the keys 100 are arranged is referred to as a scale direction. In the case where the white keys 100*w* and the black keys 100*b* can be described without any special discrimination therebetween, they may be referred to as the keys 100. In the case where a reference symbol is accompanied by "w" at the last of the symbol, it means a component corresponding to the white key. In addition, in the case where a reference symbol is accompanied by "b" at the last of the symbol, it means a component corresponding to the black key.

Part of the keyboard assembly 10 is present inside a housing 90. As the keyboard apparatus 1 is viewed from above, that part of the keyboard assembly 10 which is covered by the housing 90 is referred to as a non-visible part (non-external-appearance part) NV, whereas that part of the keyboard assembly 10 which is exposed from the housing 90 and is visible from the user is referred to as a visible part (external appearance part) PV. That is, the visible part PV is the part of the keys 100, and depicts a region where a user's playing operation can be performed. In the following, that part of the key 100 which is exposed as the visible part PV may be referred to as a key main body part.

A sound source device 70 and a speaker 80 are disposed inside the housing 90. The sound source device 70 generates a sound waveform signal attendant on depression of a key 100. The speaker 80 outputs the sound waveform signal generated in the sound source device 70 to the external space. Note that the keyboard apparatus 1 may include a slider for controlling sound volume, a switch for changing over tone color, a display for displaying various kinds of information, or the like.

Note that in the description herein, the directions or sides such as the upper side, the lower side, the left side, the right side, this side, and the depth side indicate the directions or side as the keyboard apparatus 1 is viewed from the player at the time of playing. Therefore, for example, it can be expressed that the non-visible part NV is located on the depth side as compared to the visible part PV. In addition, the directions or sides may be indicated with the keys 100 as a reference, such as the key front end side (key front side) and the key rear end side (key rear side). In this case, the key front end side indicates the front side (player's side) as viewed from the player with reference to the key 100, and the key rear side indicates the depth side as viewed from the player with reference to the key 100. According to this definition, it can be expressed that the part of the black key 100*b* which ranges from the front end to the rear end of the key main body part of the black key 100*b* is a part projecting upward as compared to the white key 100*w*.

Figure 2:
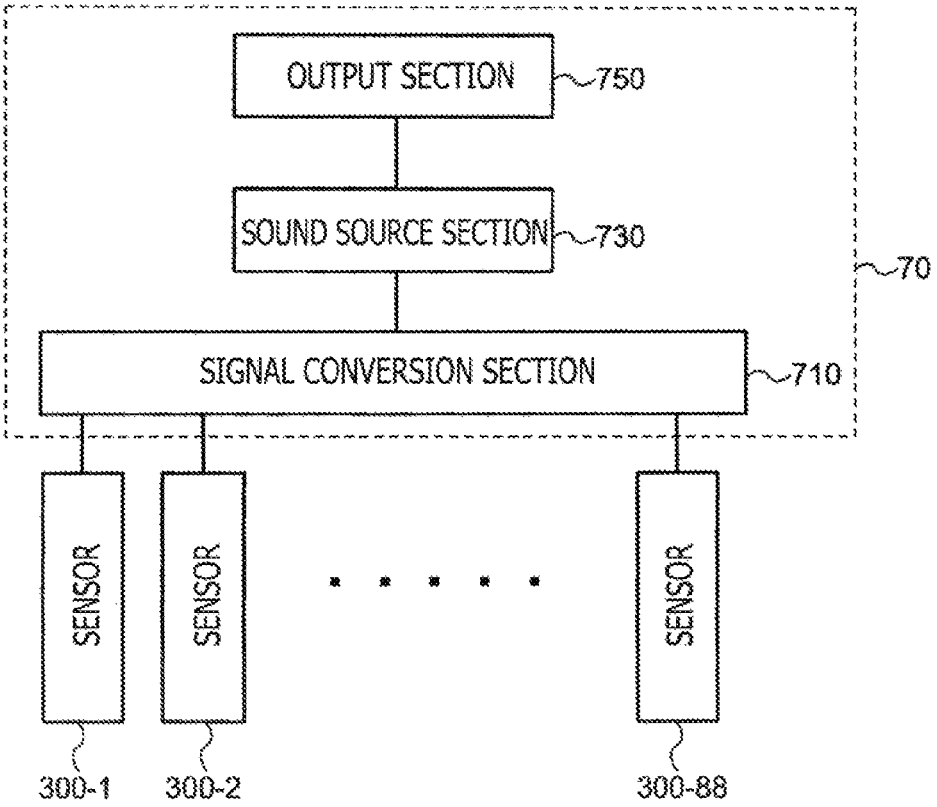
FIG. 2 is a block diagram depicting the configuration of a sound source device in one embodiment of the present invention.

FIG. 2 is a block diagram depicting the configuration of the sound source device in the first embodiment. The sound source device 70 includes a signal conversion section 710, a sound source section 730, and an output section 750. Sensors 300 are each provided correspondingly to each key 100, and detect operations of the keys and output signals corresponding to the contents of detection. In this example, the sensors 300 each output signals according to three levels of key depression amount. Key depression velocity can be detected according to the interval of the signals.

The signal conversion section 710 acquires output signals from the sensors 300 (sensors 300-1, 300-2, . . . , 300-88 corresponding to the 88 keys 100), and generates and outputs operation signals according to the operation state of each of the keys 100. In this example, the operation signal is a signal in MIDI format. Therefore, according to a key depressing operation, the signal conversion section 710 outputs a note-on signal. In this instance, a key number indicating which one of the 88 keys 100 is operated and a velocity signal corresponding to the key depression velocity are also output in correspondence with the note-on signal. On the other hand, according to a key parting operation, the signal conversion section 710 outputs a key number and a note-off signal in correspondence with each other. Signals according to other operations such as an operation of a pedal may be input to the signal conversion section 710, and they may be reflected on the operation signals.

The sound source section 730 generates sound waveform signals, based on the operation signals output from the signal conversion section 710. The output section 750 outputs the sound waveform signals generated by the sound source section 730. The sound waveform signals are output, for example, to the speaker 80, a sound waveform signal output terminal or the like.

[Configuration of Keyboard Assembly]

Figure 3:
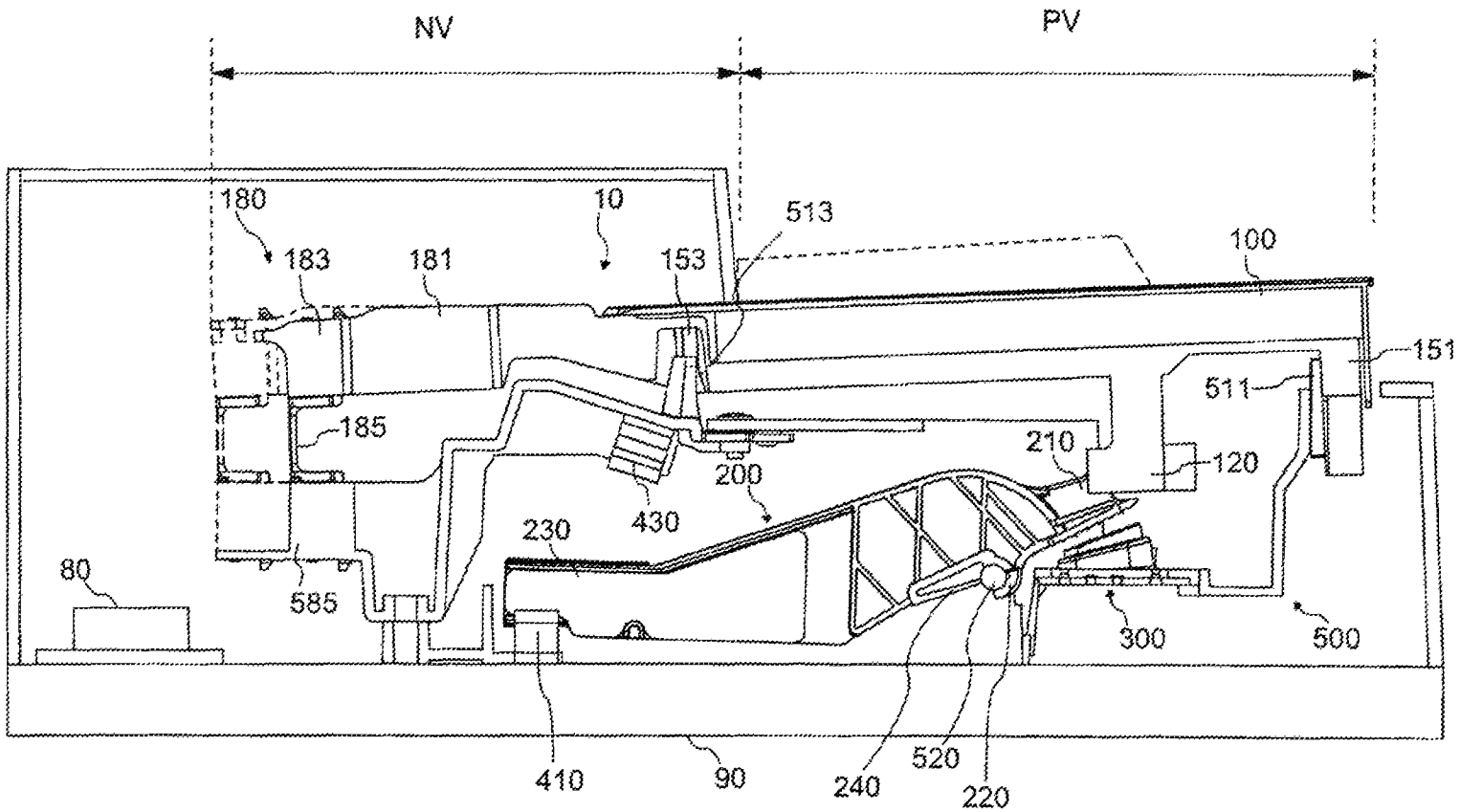
FIG. 3 is a figure for explaining the configuration of the inside of a housing in one embodiment of the present invention, as viewed sideways.

FIG. 3 is a figure for explaining the configuration of the inside of the housing in the first embodiment, as viewed sideways. As depicted in FIG. 3, the keyboard assembly 10 and the speaker 80 are disposed inside the housing 90. The speaker 80 is disposed on the depth side of the keyboard assembly 10. The speaker 80 is disposed in such a manner as to output a sound according to key depression toward the upper side and the lower side of the housing 90. The sound output downward is propagated from the lower side of the housing 90 to the exterior. On the other hand, the sound output upward is propagated from the inside of the housing 90 through an internal space of the keyboard assembly 10, and is propagated to the exterior through gaps between the adjacent keys 100 in the visible part PV or through gaps between the keys 100 and the housing 90.

The configuration of the keyboard assembly 10 will be described using FIG. 3. The keyboard assembly 10 includes a connection section 180, a hammer assembly 200, and a frame 500, in addition to the aforementioned keys 100. The keyboard assembly 10 is a resin-made structural body of which most components are produced by injection molding or the like. The frame 500 is fixed to the housing 90. The connection section 180 connects the keys 100 rotatably relative to the frame 500. The connection section 180 includes a plate-shaped flexible member 181, a key side support section 183, and a rod-shaped flexible member 185. The plate-shaped flexible member 181 extends from the rear end of the key 100. The key side support section 183 extends from the rear end of the plate-shaped flexible member 181. The rod-shaped flexible member 185 is supported by the key side support section 183 and a frame side support section 585 of the frame 500. In other words, the rod-shaped flexible member 185 is disposed between the key 100 and the frame 500. With the rod-shaped flexible member 185 bent, the key 100 can be rotated relative to the frame 500. The rod-shaped flexible member 185 is configured to be attachable to and detachable from the key side support section 183 and the frame side support section 585. Note that the rod-shaped flexible member 185 may be configured not to be attachable and detachable, by being integrated with the key side support section 183 and the frame side support section 585 or being fixed thereto by adhesion or the like.

The key 100 includes a front end key guide 151 and side key guides 153. The front end key guide 151 is in slidable contact with a front end frame guide 511 of the frame 500 in the state of covering the front frame guide 511. The front end key guide 151 is in contact with the front end frame guide 511 on both sides in regard of the scale direction of an upper portion and a lower portion thereof. The side key guides 153 are in slidable contact with a side frame guide 513 on both sides in regard of the scale direction. In this example, the side key guides 153 are disposed in those regions at side surfaces of the key 100 which correspond to the non-visible part NV, and is present on the key front end side as compared to the connection section 180 (the plate-shaped flexible member 181), but may be disposed in regions corresponding to the visible part PV.

The hammer assembly 200 is rotatably mounted to the frame 500. In this instance, the hammer assembly 200 has a shaft section 520 of the frame 500 supported by a bearing section 220 and a support section 240, and the shaft section 520 makes sliding contact with the bearing section 220 and the support section 240 at least three points. A front end portion 210 of the hammer assembly 200 makes contact with a hammer support section 120 of the key 100 slidably in substantially the front-rear direction in an internal space of the hammer support section 120. The sliding part, or the part where the front end portion 210 and the hammer support section 120 make contact with each other, is located on the lower side of the key 100 in the visible part PV (the front side as compared to the rear end of the key main body part). Note that the configuration of a connection part between the shaft section 520 and the bearing section 220 (rotating mechanism) will be described in detail later.

The hammer assembly 200 has a metallic weight part 230 disposed on the depth side as compared to the rotational axis. At normal time (when a key is not depressed), the weight part 230 is in the state of being placed on a lower stopper 410, and the front end portion 210 of the hammer assembly 200 is pushing back the key 100. When the key is depressed, the weight part 230 is moved upward, to collide on an upper stopper 430. The hammer assembly 200 applies a load to key depression by the weight part 230. The lower stopper 410 and the upper stopper 430 are formed from a buffer material (nonwoven fabric, elastic material or the like).

Under the hammer support section 120 and the front end portion 210, the sensor 300 is attached to the frame 500. When the sensor 300 is crushed on the lower surface side of the front end portion 210 due to key depression, the sensor 300 outputs a detection signal. The sensor 300 is provided correspondingly to each key 100, as aforementioned.

[Configuration of Rotating Mechanism of Hammer Assembly]

Figure 4:
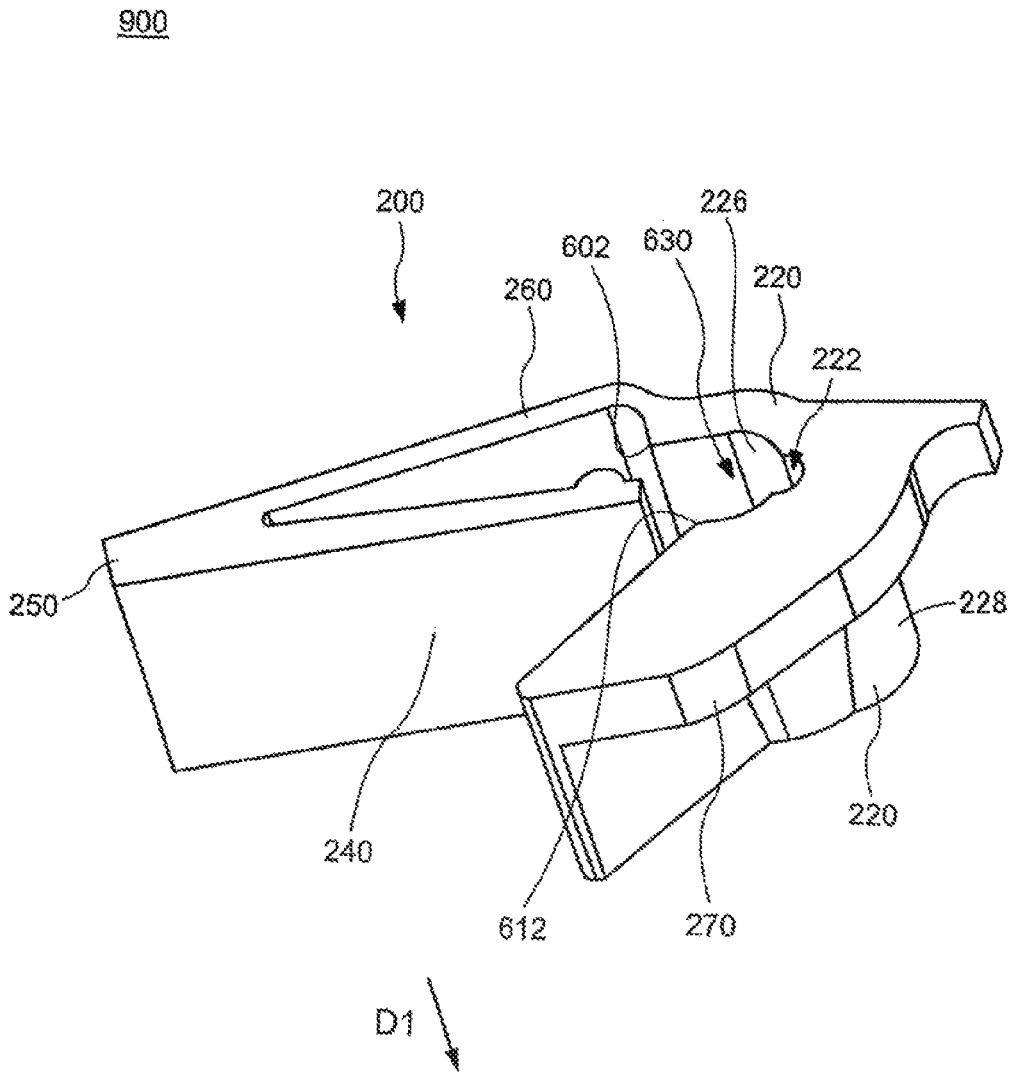
FIG. 4 is a perspective view of a bearing section of a hammer assembly in one embodiment of the present invention, as viewed from the side of one side surface.
Figure 5:
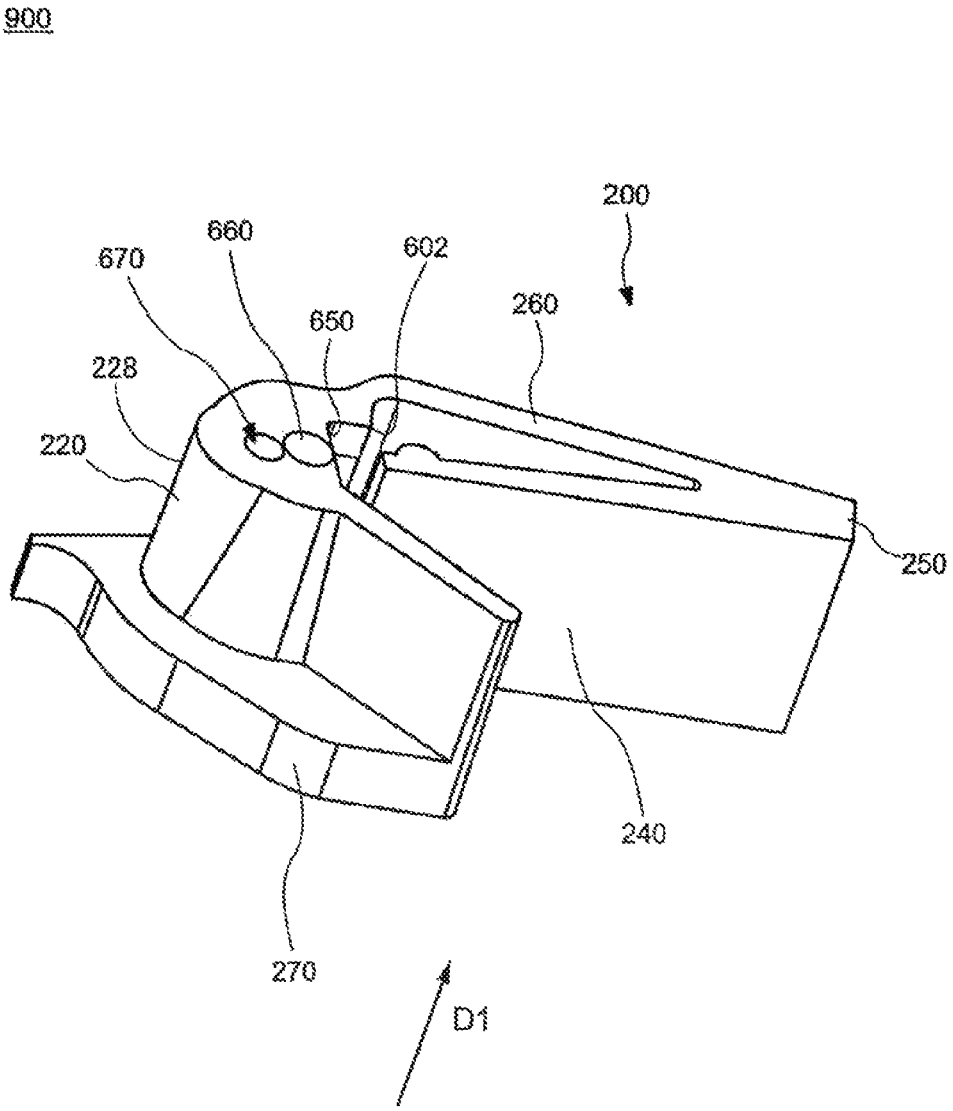
FIG. 5 is a perspective view of the bearing section of the hammer assembly in one embodiment of the present invention, as viewed from the side of the other side surface.

FIGS. 4 and 5 are perspective views, as viewed from one side surface side and the other side surface side, of the bearing section of the hammer assembly in one embodiment of the present invention. The configuration of the bearing section 220 in a rotating mechanism 900 of the hammer assembly 200 will be described in detail using FIGS. 4 and 5. Note that in FIGS. 4 and 5, the shaft section 520 of the rotating mechanism 900 is omitted, for convenience of explanation. The hammer assembly 200 includes the bearing section 220, the support section 240, a connection section 250, a body section 260, and a rib 270. Here, the rotating mechanism 900 includes at least the shaft section 520 which is a rotational axis of the hammer assembly 200, and the bearing section 220 rotatable relative to the shaft section 520. While a configuration wherein the bearing section 220 is rotated relative to the shaft section 520 being fixed will be described in the following description, the following embodiment is also applicable to a configuration wherein the shaft section 520 is rotated relative to the bearing section 220 being fixed.

Figure 7A:
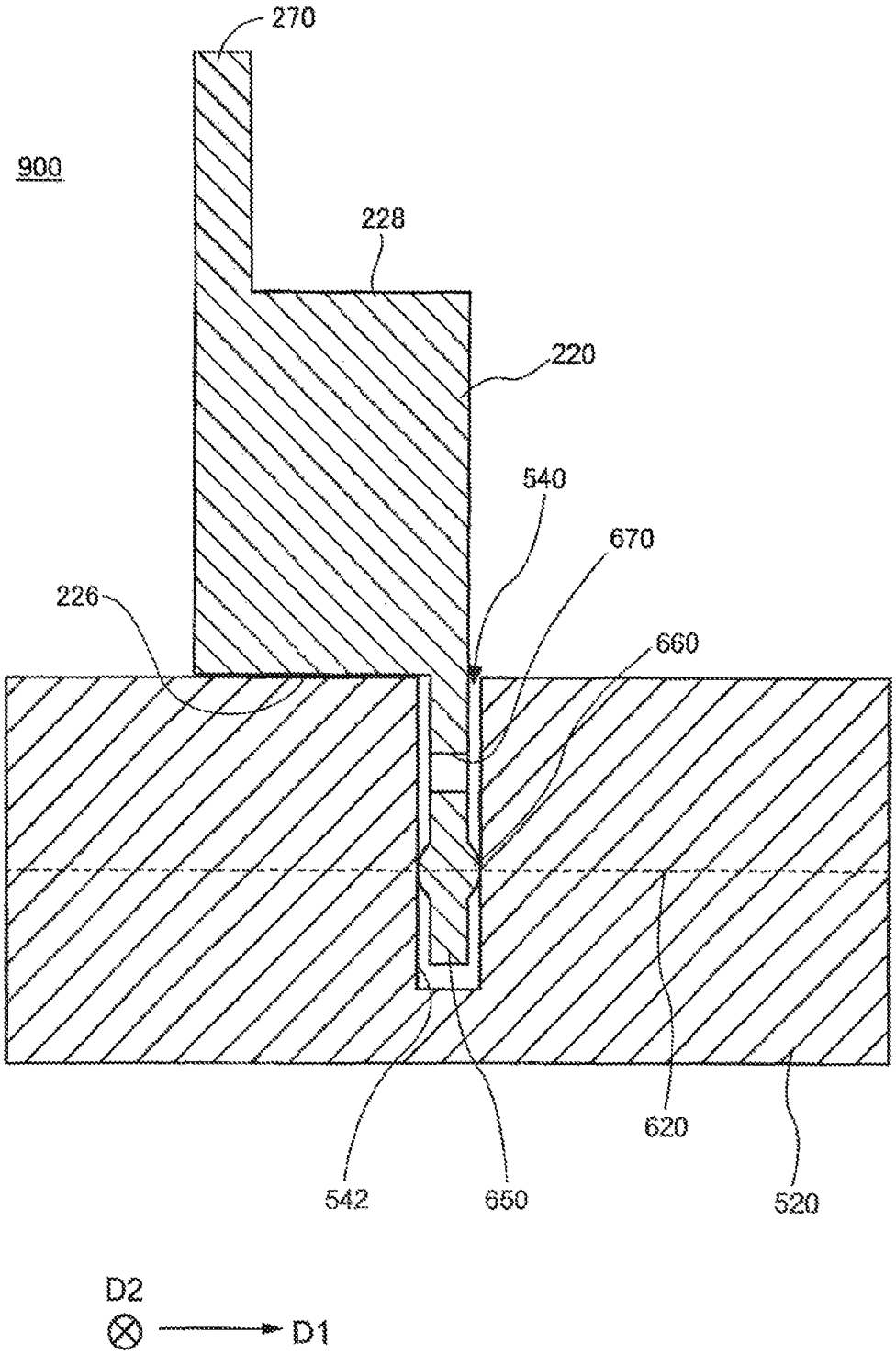
FIG. 7A is a sectional view depicting a rotating mechanism of the hammer assembly in one embodiment of the present invention.
Figure 7B:
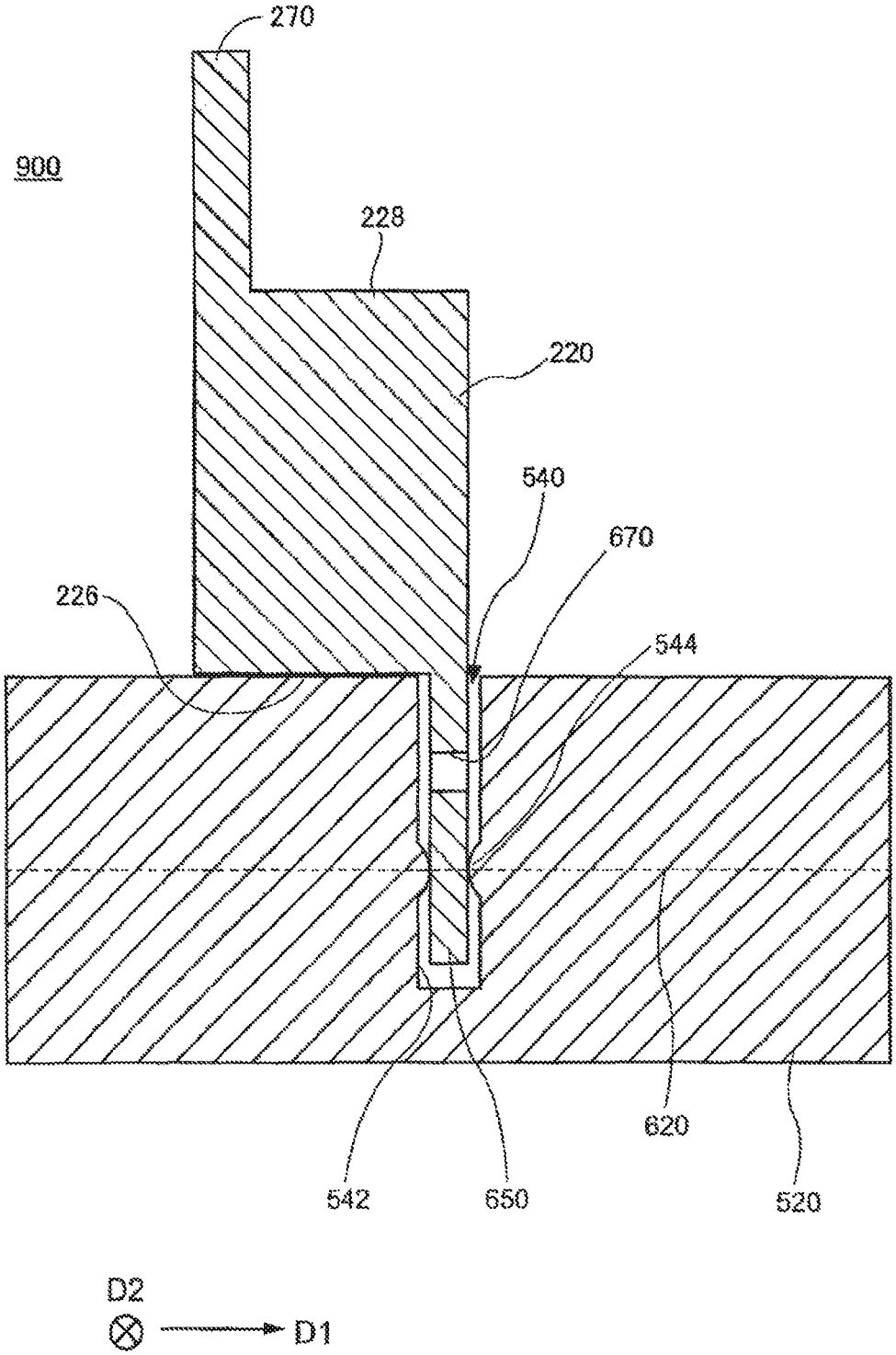
FIG. 7B is a sectional view depicting the rotating mechanism of the hammer assembly in one embodiment of the present invention.

The bearing section 220 is rotated around a rotational axis (a rotational axis 620 in FIGS. 7A and 7B). In this example, the rotational axis of the bearing section 220 exists inside the shaft section 520. The bearing section 220 is cylindrical in shape, with the rotational axis as a center. The bearing section 220 is provided with an opening 630 which is composed of the cylinder inside of the cylindrical bearing section 220 and a cutout formed by cutting out part of the cylindrical portion. The shaft section 520 is supported in a region in the inside of the opening 630. The shaft section 520 is supported in a state in which an outer peripheral portion 544 of the shaft section 520 is in contact with an inner peripheral surface 226 of the bearing section 220. In an extending direction D1 (one example of a first direction) of the shaft section 520, the opening 630 is exposed to the outside of the bearing section 220 on one side surface side of the bearing section 220 (refer to FIG. 4). On the other hand, in the D1 direction, on the other side surface side of the bearing section 220, the bearing section 220 has a shielding plate 650 (one example of an extension portion) that shields part of the opening 630. While details will be described later, the shielding plate 650 is provided with a projecting portion 660 and a through-hole 670.

The rib 270 is provided at a position on the opposite side of the bearing section 220 from the position where the opening 630 is formed. The rib 270 has a shape of projecting to the outside from an outer peripheral surface 228 of the bearing section 220 on the side opposite to the opening 630, and extends in a circumferential direction of a circle on a plane orthogonal to the rotational axis of the bearing section 220, with one point on the rotational axis on the outside of the bearing section 220 as a center. In the D1 direction, the rib 270 is provided on the outer peripheral surface 228 on the opposite side of the bearing section 220 from the inner peripheral surface 226 on the side where the shielding plate 650 is provided. In addition, in the present embodiment, in the D1 direction, the rib 270 is provided at an end portion of the bearing section 220 on the side opposite to an end portion of the bearing section 220 where the shielding plate 650 is provided. The bearing section 220 and the rib 270 are formed integrally.

With the shielding plate 650 provided, mechanical strength of the bearing section 220 provided with the opening 630 is enhanced. With the rib 270 provided, the mechanical strength of the bearing section 220 is further enhanced. Thus, the bearing section 220 is enhanced in mechanical strength on the inner circumference side and the outer circumference side thereof, as compared to a bearing section not provided with the shielding plate 650 or the rib 270. Besides, with the rib 270 provided on the opposite side of the bearing section 220 from the shielding plate 650 in the D1 direction, mechanical strength at both end portions of the bearing section 220 is enhanced. While the rib 270 may be provided over the whole range in the above-mentioned circumferential direction on the outside of the bearing section 220, the rib 270 need only be provided at least partly in the circumferential direction. The rib 270 may be formed separately from the bearing section 220 and may be joined to the bearing section 220.

The width between opening ends 602 and 612 of the opening 630 is not smaller than a maximum diameter of the shaft section 520. In other words, the rotating mechanism 900 has a structure in which the shaft section 520 is not locked by the bearing section 220. It is to be noted, however, that a structure in which the width between the opening ends 602 and 612 is smaller than the maximum diameter of the shaft section 520, or so-called snap-fit structure, may be adopted. In the case where the rotating mechanism 900 is of the snap-fit structure, the support section 240 may be disposed at such a position that the tip of the support section 240 does not contact the shaft section 520, and the support section 240 may be omitted.

The inner peripheral surface 226 of the opening 630 is further provided with a groove 222 extending in the D1 direction. The groove 222 can be utilized as a grease sump. Furthermore, with the groove 222 provided, the area of contact between the shaft section 520 and the bearing section 220 can be reduced, and a frictional force in a rotating operation of the shaft section 520 and the bearing section 220 can be reduced.

The support section 240 is fixed to the bearing section 220 through the connection section 250 and the body section 260. The connection section 250 is provided on the opposite side of the body section 260 from the bearing section 220. The connection section 250 extends from the body section 260 toward the lower side of the body section 260. The support section 240 is connected to a lower end of the connection section 250, and extends from the connection section 250 toward the bearing section 220. The shaft section 520 is supported by a tip (an end portion on the bearing section 220 side) of the support section 240.

The support section 240 is flexible, and can be flexed at least in the direction of approaching the body section 260. In the present embodiment, the support section 240 can be flexed in the direction of approaching the body section 260 and in the direction of coming away from the body section 260. With the support section 240 flexed in the direction of approaching the body section 260, attachment and detachment of the bearing section 220 to and from the shaft section 520 are performed. Here, the support section 240 is of a structure wherein flexure thereof in such a direction that the bearing section 220 is detached from the shaft section 520 (namely, the direction from the shaft section 520 toward the support section 240) is restrained.

Figure 6:
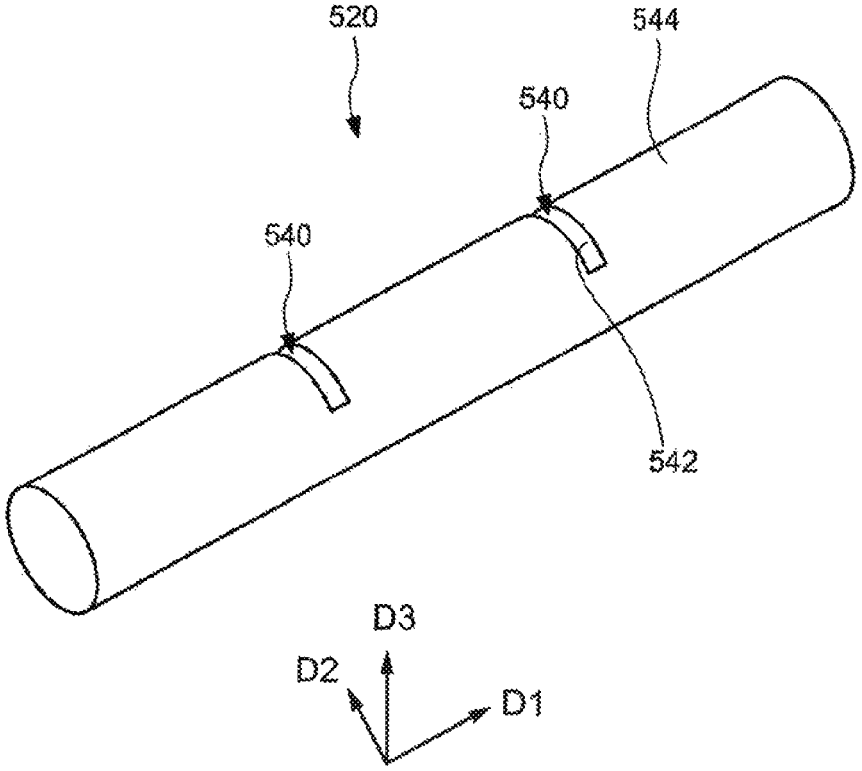
FIG. 6 is a perspective view of a shaft section in one embodiment of the present invention.

FIG. 6 is a perspective view of the shaft section in one embodiment of the present invention. The shaft section 520 is provided with a plurality of grooves 540. An inner surface 542 of the groove 540 includes a surface intersecting the D1 direction. In the present embodiment, a configuration wherein the inner surface 542 includes a surface orthogonal to the D1 direction is depicted as an example. In other words, the inner surface 542 is a surface extending in the D2 direction, and a D3 direction. Here, the D1 direction, the D2 direction and the D3 direction are mutually orthogonal directions. The plurality of grooves 540 are arranged in the D1 direction at the same pitch as the pitch at which the hammer assemblies 200 are disposed. In the groove 540, the shielding plate 650 formed in the bearing section 220 is inserted. In other words, a corresponding one of the shielding plates 650 of the plurality of bearing sections 220 is inserted in each of the plurality of grooves 540. Thus, the shielding plates 650 are disposed in the grooves 540 provided at the same pitch as the hammer assemblies 200, whereby alignment of the bearing sections 220 to the shaft section 520 can be performed easily. As depicted in FIG. 7A described later, the bottom of the groove 540 is formed in a recessed shape toward the center of the shaft section 520 from an outer peripheral surface 544 of the shaft section 520 such that in a state in which the bearing section 220 is mounted to the shaft section 520 and separated from a tip of the shielding plate 650. In addition, the groove 540 is formed in a recessed shape such that the shielding plate 650 can move in the groove 540 when the bearing section 220 is rotated relative to the shaft section 520. Specifically, at least a part corresponding to a movement region of the shielding plate 650 at the time of relative rotation of the shaft section 520 and the bearing section 220 is removed from the shaft section 520, whereby the groove 540 is formed.

FIG. 7A is a sectional view depicting the rotating mechanism of the hammer assembly in one embodiment of the present invention. FIG. 7A depicts a state in which the bearing section 220 is mounted to the shaft section 520. The dotted line extending in the D1 direction is the rotational axis 620 of the rotating mechanism 900. In other words, the rotational axis 620 is the center of rotation of the bearing section 220. In the state depicted in FIG. 7A, the shielding plate 650 shields a region containing the rotational axis 620. The projecting portion 660 projects from the shielding plate 650 toward the inner surface 542, between the shielding plate 650 and the inner surface 542 of the groove 540. The projecting portion 660 is provided in a region containing the rotational axis 620. The shielding plate 650 is provided at an end portion of the bearing section 220 in regard of the D1 direction. The through-hole 670 penetrates the shielding plate 650 in the plate thickness direction.

The configuration wherein the projecting portion 660 is provided in the region containing the rotational axis 620 reduces the region in which the projecting portion 660 slides on the inner surface 542 of the groove 540 when the bearing section 220 is rotated. Therefore, the rotating operation of the bearing section 220 can be smoothened, and friction between the projecting portion 660 and the inner surface 542 can be restrained. With the shielding plate 650 provided with the through-hole 670, the through-hole 670 can be utilized as a grease sump.

In the case where the bearing sections 220 and the shielding plates 650 as well as the grooves 540 of the shaft section 520 are produced by resin molding, it is difficult to accurately form relative positions of the shielding plates 650 and the grooves 540, from the viewpoint of characteristics of the mold used for the resin molding. However, with the shielding plate 650 provided at an end portion of the bearing section 220 in regard of the D1 direction, the shape of the shielding plate 650 can be formed only by the mold of either a cavity or a core. Therefore, the positions of the shielding plates 650 relative to the bearing sections 220 and the shapes of the shielding plates 650 themselves can be formed accurately.

Note that a configuration wherein the projecting portion 660 is provided on the shielding plate 650 is depicted as an example in FIG. 7A, this configuration is not limitative. For example, as depicted in FIG. 7B, a projecting portion 544 projecting from the inner surface 542 of the shaft section 520 toward the shielding plate 650 may be provided. The projecting portion 660 may be provided in other region than the region of the rotational axis 620. The shielding plate 650 may not shield the rotational axis 620. The shielding plate 650 and the inner surface 542 may be provided with no projecting portion, and the shielding plate 650 and the inner surface 542 may make surface contact with each other. The through-hole 670 may be provided on a deeper part of the groove 540 than the projecting portion 660. In addition, the through-hole 670 may not be provided.

As has been described above, according to the rotating mechanism 900 according to the first embodiment, the shielding plate 650 is provided on one side surface side of the opening 630 provided in the bearing section 220 in regard of the D1 direction, whereby mechanical strength of the bearing section 220 is enhanced. Therefore, deformation of the bearing section 220 is restrained, and, accordingly, a rotating mechanism 900 enabling stable rotation of the bearing section 220 relative to the shaft section 520 can be realized.

[Operation of Keyboard Assembly]

Figure 8:
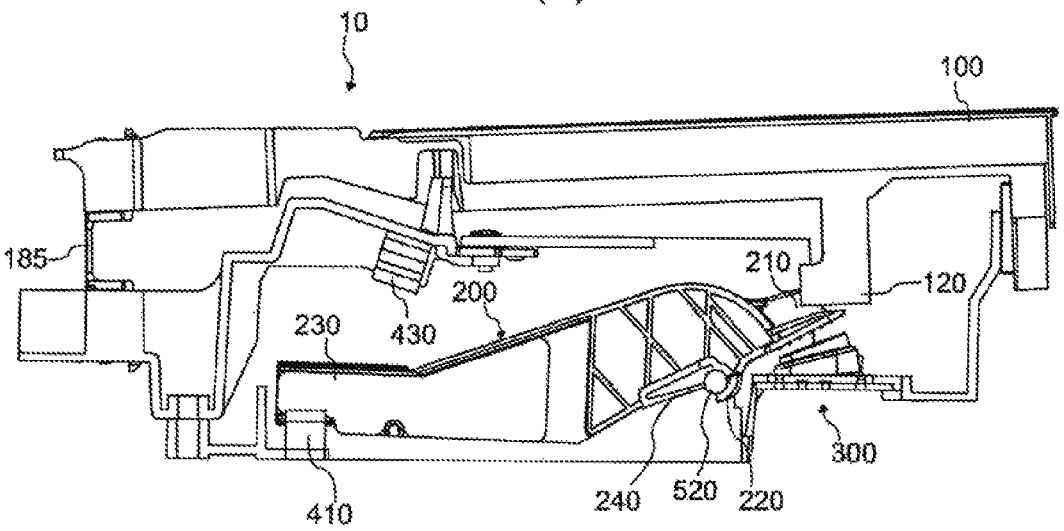
FIG. 8 is a figure for explaining an operation of a key assembly when a key (white key) is depressed in one embodiment of the present invention.
Figure 8:
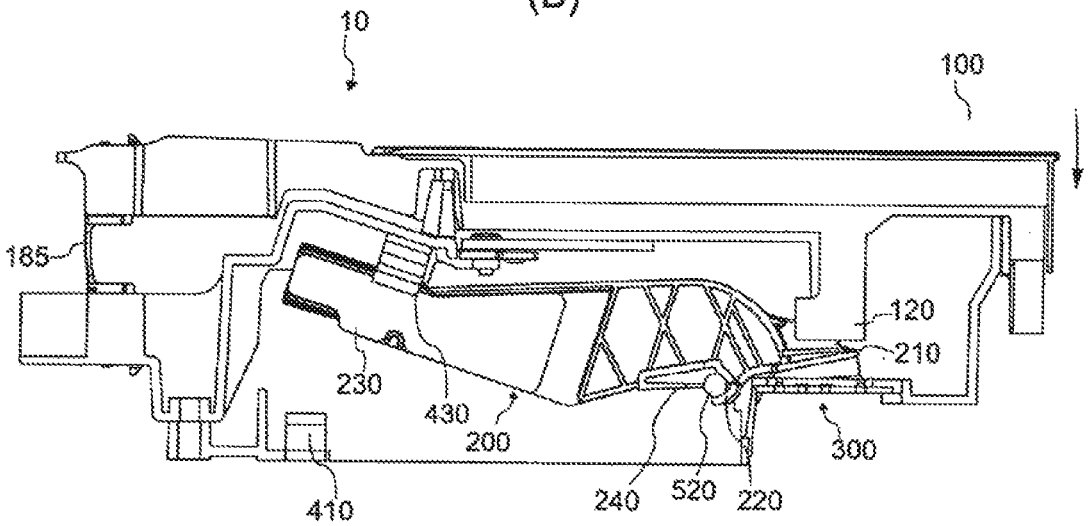

FIG. 8 depicts figures for explaining an operation of the key assembly when a key (white key) is depressed in one embodiment of the present invention. FIG. 8(A) is a figure in a case where the key 100 is in a rest position (a state of not depressing the key). FIG. 8(B) is a figure in a case where the key 100 is at an end position (a state of depressing the key to the last). When the key 100 is depressed, the rod-shaped flexible member 185 is flexed in the manner of being a center of rotation. In this instance, the rod-shaped flexible member 185 undergoes flexing deformation to the front side (the player's side) of the key, but, due to restriction of movement in the front-rear direction by the side key guide 153, the key 100 is not moved to the front side but is rotated. Then, with the hammer support section 120 depressing the front end portion 210, the hammer assembly 200 is rotated with the shaft section 520 as a center. With the weight part 230 colliding on the upper stopper 430, rotation of the hammer assembly 200 is stopped, and the key 100 reaches the end position. In addition, when the sensor 300 is crushed by the front end portion 210, the sensor 300 outputs a detection signal, at a plurality of levels according to the crushing amount (key depression amount).

On the other hand, when the finger is detached from the key, the weight part 230 is moved downward, the hammer assembly 200 is rotated, and the key 100 is rotated upward. With the weight part 230 coming into contact with the lower stopper 410, rotation of the hammer assembly 200 is stopped, and the key 100 is returned into the rest position. In the keyboard apparatus 1 in the first embodiment, the key 100 is rotated by depression of the key and detachment of the finger from the key, at the connection section 180, as aforementioned.

Second Embodiment

Figure 9:
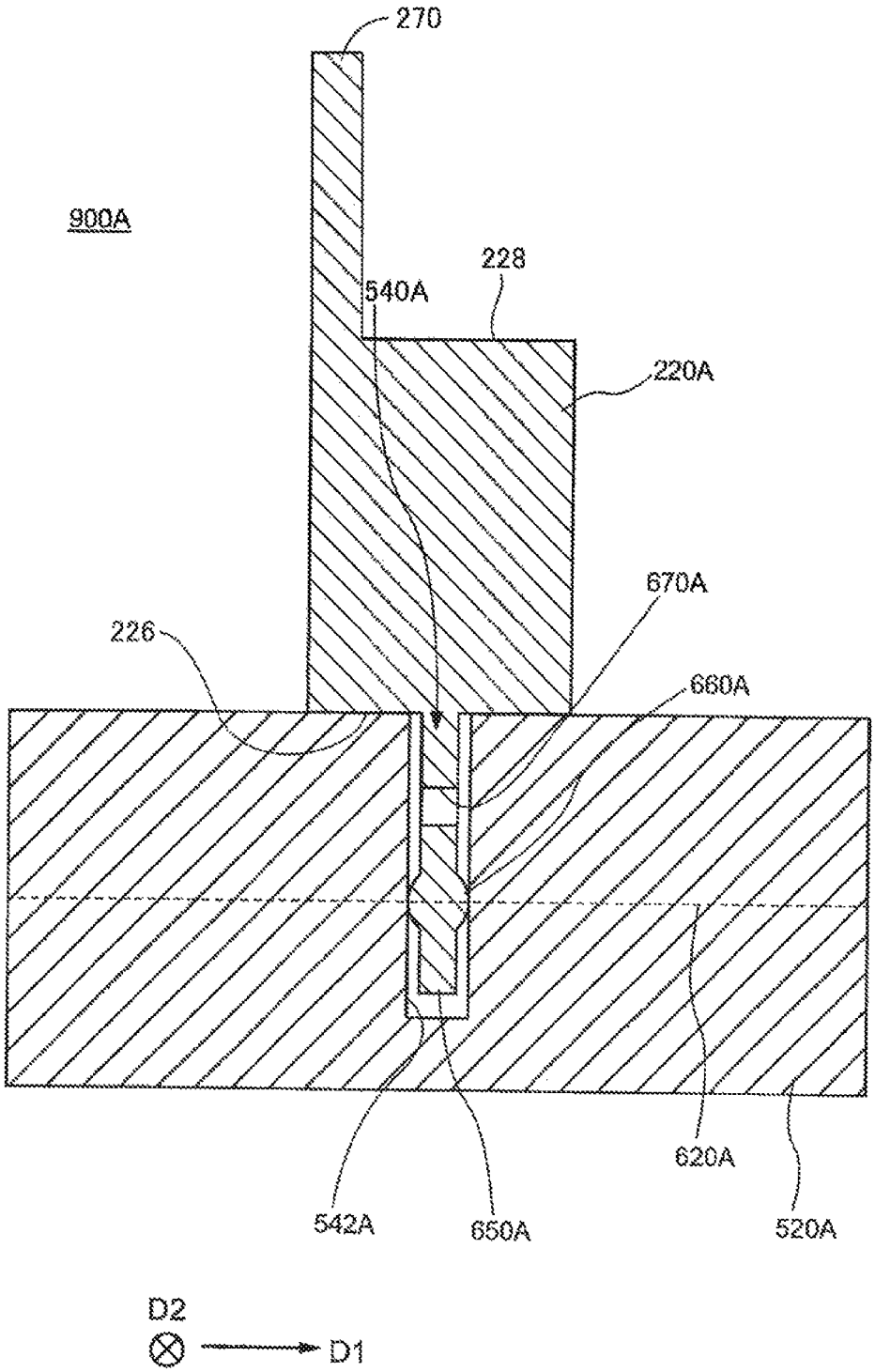
FIG. 9 is a sectional view depicting the rotating mechanism of the hammer assembly in one embodiment of the present invention.

In a second embodiment, a rotating mechanism 900A having a configuration different from that of the rotating mechanism 900 in the first embodiment will be described. FIG. 9 is a sectional view depicting a rotating mechanism of a hammer assembly in one embodiment of the present invention. In the rotating mechanism 900A in the second embodiment, mainly the position of mounting a shielding plate 650A to a bearing section 220A is different from that in the case of the bearing section 220 in the first embodiment.

The shielding plate 650A of the rotating mechanism 900A is provided between both ends of the bearing section 220A in regard of the D1 direction. In FIG. 9, there is depicted a configuration wherein the shielding plate 650A is provide near the center of the bearing section 220A in regard of the D1 direction. In the case of this configuration, a shaft section 520A supports the bearing section 220A on both sides of a groove 540A in regard of the D1 direction. By this configuration, strength of supporting the bearing section 220A by the shaft section 520A can be enhanced. In the case of the configuration depicted in FIG. 9, a rib 270A may be provided at both end portions of the bearing section 220A in regard of the D1 direction, or may be provided at either one of the end portions.

As has been described above, according to the rotating mechanism 900A according to the second embodiment, the same or similar effect to that of the rotating mechanism 900 in the first embodiment can be obtained.

In the aforementioned embodiments, an electronic piano has been depicted as an example of the keyboard apparatus to which a hammer assembly is applied. On the other hand, the hammer assembly in the above embodiments can also be applied to a rotating mechanism of an acoustic piano (for example, a grand piano or an upright piano). For instance, in an upright piano, the opening mechanism in the above embodiments can be applied to a rotating mechanism which has a rotating component part and a support section rotatably supporting the rotating component part. In this case, a sound generating mechanism corresponds to hammers and strings. The rotating mechanism in the above embodiments can also be applied to rotating component parts of other things than the piano.

Note that the present invention is not limited to the above embodiments, and modifications can be appropriately made within the scope of the gist of the invention.

REFERENCE SIGNS LIST

1: Keyboard apparatus, 10: Keyboard assembly, 70: Sound source device, 80: Speaker, 90: Housing, 100: Key, 100*b*: Black key, 100*w*: White key, 120: Hammer support section, 151: Front end key guide, 153: Side key guide, 180: Connection section, 181: Plate-shaped flexible member, 183: Key side support section, 185: Rod-shaped flexible member, 200: Hammer assembly, 210: Front end portion, 220: Bearing section, 222: Groove, 230: Weight part, 240: Support section, 250: Connection section, 260: Body section, 270: Rib, 300: Sensor, 410: Lower stopper, 430: Upper stopper, 500: Frame, 511: Front end frame guide, 513: Side frame guide, 520: Shaft section, 540: Groove, 542: Inner surface, 585: Frame side support section, 602, 612: Opening end, 620: Rotational axis, 630: Opening, 650: Shielding plate, 660: Projecting portion, 670: Through-hole, 710: Signal conversion section, 730: Sound source section, 750: Output section, 900: Rotating mechanism

The invention claimed is:

1. A rotating mechanism, comprising:
a shaft; and
a bearing that has an inner peripheral surface, wherein
the inner peripheral surface of the bearing is in contact with an outer peripheral surface of the shaft and the bearing is rotatable around a rotational axis relative to the shaft,
the inner peripheral surface of the bearing has an extension extending from the inner peripheral surface toward the rotational axis, and the outer peripheral surface of the shaft has a groove,
the extension is in an inserted state in an inside of the groove,
the extension is movable when the bearing is rotated relative to the shaft, and
the extension is in a region inside the groove, the region containing the rotational axis.

2. The rotating mechanism according to claim 1, wherein the extension has a projecting portion projecting from a plate-shaped member toward an inner surface of the groove, inside the groove.

3. The rotating mechanism according to claim 1, wherein the shaft has a projecting portion projecting from an inner surface of the groove toward the extension, inside the groove.

4. The rotating mechanism according to claim 2, wherein the projecting portion is in a region containing the rotational axis.

5. The rotating mechanism according to claim 3, wherein the projecting portion is in a region containing the rotational axis.

6. The rotating mechanism according to claim 1, wherein the extension has a through-hole penetrating the plate-shaped member in a plate thickness direction.

7. The rotating mechanism according to claim 1, wherein the extension at an end portion of the bearing, in a first direction parallel to the rotational axis.

8. The rotating mechanism according to claim 1, wherein the extension is between both ends of the bearing, in a first direction parallel to the rotational axis.

9. The rotating mechanism according to claim 7, wherein the bearing has a rib at an end portion of the bearing on a side opposite to the end portion of the bearing where the extension is provided, in the first direction, at an outer peripheral surface of the bearing.

10. The rotating mechanism according to claim 1, wherein the shaft has a plurality of the grooves arranged in a first direction parallel to the rotational axis.

11. A keyboard apparatus, comprising:
a key;
a hammer assembly rotatable around a rotating mechanism in response to depression of the key, wherein
the rotating mechanism, comprising:
a shaft; and
a bearing that has an inner peripheral surface, wherein
the inner peripheral surface of the bearing is in contact with an outer peripheral surface of the shaft and the bearing is rotatable around a rotational axis relative to the shaft,
the inner peripheral surface of the bearing has an extension extending from the inner peripheral surface toward the rotational axis, and the outer peripheral surface of the shaft has a groove,
the extension is in an inserted state in an inside of the groove,
the extension is movable when the bearing is rotated relative to the shaft, and
the extension is in a region inside the groove, the region containing the rotational axis;
a sensor that is under the key and detects an operation on the key; and
a sound source that generates a sound waveform signal according to an output signal from the sensor.

* * * * *